US008448595B2

(12) United States Patent
Cook-Thalacker

(10) Patent No.: US 8,448,595 B2
(45) Date of Patent: May 28, 2013

(54) DEVICE FOR MARKING AND IDENTIFYING A MULTITUDE OF PAGES IN A BOOK

(75) Inventor: Teresa Cook-Thalacker, Thornton, CO (US)

(73) Assignee: Remote Interaction LLC, Thornton, CO (US)

( * ) Notice: Subject to any disclaimer, the term of this patent is extended or adjusted under 35 U.S.C. 154(b) by 408 days.

(21) Appl. No.: 12/825,666

(22) Filed: Jun. 29, 2010

(65) Prior Publication Data

US 2011/0315069 A1 Dec. 29, 2011

(51) Int. Cl.
*B42D 9/00* (2006.01)

(52) U.S. Cl.
USPC ..... 116/234; 116/238; 281/42

(58) Field of Classification Search
CPC ..... B42D 9/00
USPC ..... 116/234, 235, 240, 236–239; 281/42; D19/34; 428/201–204; 273/240; 24/709.2
See application file for complete search history.

(56) References Cited

U.S. PATENT DOCUMENTS

| | | | | | |
|---|---|---|---|---|---|
| 83,486 | A | * | 10/1868 | Griggs | 63/20 |
| 255,545 | A | * | 3/1882 | Stedwell | 281/47 |
| 761,556 | A | * | 5/1904 | Tack | 116/238 |
| 838,386 | A | * | 12/1906 | Crouch | 116/234 |
| 901,225 | A | * | 10/1908 | Brockett et al. | 116/238 |
| 922,110 | A | * | 5/1909 | Eberle | 116/238 |
| 1,322,796 | A | | 11/1919 | Kissel | |
| 1,380,031 | A | * | 5/1921 | Abbott | 116/239 |
| 1,624,458 | A | | 4/1927 | Zook | |
| 1,700,846 | A | * | 2/1929 | Klein | 116/237 |
| 1,711,046 | A | * | 4/1929 | Deutsch | 116/238 |
| 1,803,726 | A | * | 5/1931 | Pfuderer | 116/238 |
| 1,816,910 | A | * | 8/1931 | Moore | 281/42 |
| 1,858,605 | A | * | 5/1932 | Von Alvensleben | 116/234 |
| 1,862,573 | A | * | 6/1932 | Grosz | 281/42 |
| 2,240,441 | A | * | 4/1941 | Hurewitz | 24/708 |
| 2,282,939 | A | * | 5/1942 | Clawson | 40/775 |
| 2,394,372 | A | | 2/1946 | Evans | |
| 2,435,886 | A | * | 2/1948 | Hayes | 116/238 |
| 2,436,609 | A | * | 2/1948 | Safier | 116/239 |
| 2,645,197 | A | | 7/1953 | Jones et al. | |
| 3,059,609 | A | | 10/1962 | Sealana | |
| 3,898,951 | A | | 8/1975 | Clare | |
| 4,721,057 | A | * | 1/1988 | Vigil | 116/238 |
| 4,793,632 | A | * | 12/1988 | Hoffman, Jr. | 281/42 |
| 4,869,529 | A | * | 9/1989 | Hoffman, Jr. | 281/42 |
| 4,941,684 | A | * | 7/1990 | Frank et al. | 281/42 |
| D314,589 | S | | 2/1991 | Cooley | |
| 5,022,342 | A | * | 6/1991 | Davis | 116/236 |
| 5,095,846 | A | * | 3/1992 | Knight | 116/238 |
| 5,245,844 | A | | 9/1993 | Panzer | |
| 5,462,006 | A | * | 10/1995 | Thiruppathi | 116/234 |
| 5,829,903 | A | * | 11/1998 | Collins | 401/131 |
| D457,561 | S | * | 5/2002 | Salz et al. | D19/34 |
| 6,439,723 | B1 | * | 8/2002 | Tano | 353/15 |
| 6,446,803 | B1 | * | 9/2002 | McKinney | 206/371 |

(Continued)

*Primary Examiner* — Peter Macchiarolo
*Assistant Examiner* — Tania Courson
(74) *Attorney, Agent, or Firm* — Sheridan Ross P.C.

(57) ABSTRACT

A bookmark system is provided that accommodates a plurality of bookmarks that are able to be selectively added and removed from a centralized head. Each bookmark is capable of sliding independently along a pin and is designed to fit between two pages of a book. The bookmark includes a member for secure integration to the book to ensure that it and its associated bookmarks remain in place during use of the book.

21 Claims, 4 Drawing Sheets

U.S. PATENT DOCUMENTS

| | | | | |
|---|---|---|---|---|
| D499,446 | S * | 12/2004 | Mershon | D19/34 |
| 7,013,540 | B2 | 3/2006 | Wang et al. | |
| 7,125,049 | B2 * | 10/2006 | Goldberg et al. | 281/42 |
| 7,475,654 | B2 * | 1/2009 | Scott | 116/237 |
| 7,757,624 | B2 * | 7/2010 | Landolt | 116/238 |
| 8,127,708 | B2 * | 3/2012 | Hertzfeld et al. | 116/239 |
| 2002/0096103 | A1 * | 7/2002 | Capstran | 116/234 |
| 2002/0158462 | A1 | 10/2002 | Antoine | |
| 2006/0238532 | A1 * | 10/2006 | LaFleur | 345/211 |
| 2008/0093837 | A1 * | 4/2008 | Lee | 281/46 |
| 2010/0058975 | A1 | 3/2010 | Hertzfeld et al. | |
| 2010/0078928 | A1 * | 4/2010 | Mercieca | 281/42 |

* cited by examiner

DEVICE FOR MARKING AND IDENTIFYING A MULTITUDE OF PAGES IN A BOOK

FIELD OF THE INVENTION

Embodiments of the present invention are generally related to a bookmark that employs a plurality of selectively removable page markers. More specifically, one embodiment of the present invention includes a bracket that includes a plurality of removable page markers that are received between individual pages of a book, thereby marking specific sections and/or pages of the book.

BACKGROUND OF THE INVENTION

Bookmarks are often employed by a reader to identify at least one page in a book for future reference and are typically fabricated of cloth or paper. Similarly flexible markers are sometimes integrated into the spine of the book with a first end fixed to an upper edge of the spine and a second end adapted to be placed between pages. Other more rigid bookmarks are comprised of a clip that interconnects with a cover of a book to associate an individual page or pages thereto, which effectively separates a first portion of the book from a second portion of the book. U.S. Pat. No. 3,898,951 to Clare is an example of a book mark that is associated with a book cover. Bookmarks sometimes consist of a flexible band that wraps around the cover of the book and a plurality of pages to separate one portion of a book from another. Bookmarks of the prior art are often misplaced. Further, bookmarks that are permanently interconnected to the book cannot be used in other books, render the book in some instances difficult to close, may be torn from the book, etc. Other types of bookmarks that clip or band pages can damage book jackets, book covers and pages.

Some bookmarks of the prior art are comprised of a first member for association with the spine of a book, between an inner portion of the spine and the bound page's edges, that are made of a metallic or ferromagnetic material. A second member of the bookmark is located outside the spine and cooperates with the first member to hold each member in place. The second member includes a plurality of page markers. The drawback of this device is that it is not easily moved from one book to another. More specifically, one must remove the magnetic or ferromagnetic first member from the book and place it in another book or page marking. Further, in order to adequately secure the second member, the first member may need to be of such a size that will make the book difficult to close. Alternatively, if magnetic, the second member may need to be large, which will make it bulky and unsightly, to function properly.

Other bookmarks of the prior art are associated with a space between the interior page edges and the inner surface of the spine and includes a plurality of page markers. The drawbacks of these devices is that the plurality of page markers are permanently fixed to a portion of the bookmark that fits between the spine and the pages. An example of such bookmarks may be found in U.S. Patent Application Publication No. 2002/0158462 to Antoine, U.S. Pat. No. 1,322,796 to Kissel, U.S. Pat. No. 3,059,609 to Scalana, U.S. Pat. No. 2,645,197 to Towes et al., U.S. Pat. No. 2,394,372 to Evans and U.S. Pat. No. D314,589 to Cooley.

It is a long felt need to provide a bookmark that provides a plurality of marking options that may be selectively associated with a book. The following disclosure teaches a bookmark that includes a device that selectively receives and secures a plurality of bookmarks, thereby providing a robust system for marking multiple pages of the book.

SUMMARY OF THE INVENTION

It is one aspect of the present invention to provide a multipage bookmark. Hardcover books are generally comprised of a front cover and a back cover that are interconnected via a spine. The pages of the book are interconnected to a liner that is associated with bands positioned at the top edge and the bottom edge of each cover such that the liner spans the distance between joints found by the interconnection of the cover to the spine. A space is thus defined by the inner surface of the spine and the liner. One embodiment of the present invention is comprised of a bracket that is selectively associated with the book by way of a spine portion that fits in the space provided between an inner surface of a book spine and the liner. An upper portion is interconnected to the spine segment and directed towards the inside of the book. The upper portion may be positioned towards the pages or towards the outside of the book, which will be apparent upon review of the figures provided herewith. A plurality of page markers are also provided that are selectively interconnected to the upper portion of the bracket and are designed to be selectively located between various pages of the book. The plurality of page markers are designed to selectively interconnect with the upper portion of the bracket such that the number of bookmarks may be altered to suit the user's needs.

It is another aspect of the present invention to add aesthetically pleasing items to the multipage bookmark. One embodiment of the present invention employs a head portion that is associated with the upper portion of the bracket. The head portion may be welded, glued, riveted, soldered, taped or otherwise interconnected to the upper portion of the bracket. In one embodiment, the head portion is adapted to receive and secure at least one photo. In other embodiments of the present invention, the head portion is comprised of a locket wherein a photo may be selectively hidden from view. To expand on this concept, it is contemplated that the head portion may be enlarged so as to receive pills, the Eucharistic host (associated with a religious ceremony, i.e., the body of Christ in a Christian ceremony), a light, etc.

It is also envisioned that the head portion may be detachable from the bracket. In one embodiment, the head portion is selectively interconnected to the bracket by way of at least one magnet. Other embodiments of the present invention employ a head portion that slidingly interconnects with the upper portion of the bracket. The detachable head portion may employ a magnifying glass to help the user read without removing the multipage book mark from the book. Such a magnifying glass may also be selectively interconnectable to a user's eyeglasses. The removable nature of the head portion of embodiments of the present invention allow for interchangeability. That is, an individual may own many brackets with associated page markers that are left in their favorite books and use a single head portion to interconnect to a selected bracket. Further, the head portion may accommodate the plurality of selectively removable page markers wherein the head portion is moved from book to book that each employ a bracket. Such bracket may be selectively interconnected to the book or be permanently integrated into the book.

It is also contemplated that embodiments of the present invention employ a powered head portion that employs a visual and/or sound media device that may be a digital media device. More specifically, one embodiment of the present invention includes a small digital picture frame incorporated into the head portion similar to those found in digital key chains. In this embodiment, the digital information would be stored in the bracket or head portion with an integrated solid state storage device that would allow for a user to search through pictures interacting with the bracket and/or head portion. Buttons needed to access a particular photo, etc., may be incorporated in the head portion and/or the bracket. The stored photos may be displayed automatically in a slide show fashion. Furthermore, the storage device may include other information, such as sound information and may be accessed by way of earphones, similar to an iPod®. The media storage device may also be associated with a Bluetooth® communication device so that data may be transmitted to a smart phone or similar device.

The head portion may also include a sound transmitter or receiver. It is envisioned that the head portion and/or bracket may employ WIFI technology or common transistor radio components wherein a sermon, for example, may be wirelessly received by the bookmark and amplified to aid hearing impaired individuals so that they enjoy the sermon or speech being given. Of course, the receiver may receive information from a broadcaster and store such information.

As alluded to above, the head portion may include a Bluetooth® device that receives and/or transmits information regarding the events taking place around the individual reading. For example, the next reading number, hymn, text of the sermon, church bulletin, or other relevant information may be sent to the bookmark system to be accessed at a later time, transmitted to a smart phone, PDA, or laptop, etc.

The head portion or bracket of one aspect of the present invention may include identification information as to the owner of the multipage book mark or book. For example, an individual's name and phone number may be engraved or otherwise indicated on the bracket. Further, the spine or head portion may include a power source used to power the devices described above or a reading light. It is also contemplated that the spine portion of the bracket may include a magnifying glass along its length or on a portion thereof wherein the multipage book mark may be removed from the book and used primarily as a magnifying glass by sight impaired individuals, for example. In addition, a word reader may be incorporated into the spine portion of the bracket for use by sight impaired or reading impaired individuals that generate digital information related to text that is exposed and saved for immediate broadcast or future broadcast.

In one embodiment of the present invention, the head portion, and/or upper portion of the bracket is severable from the spine portion. In another embodiment of the present invention the upper portion and the spine portion are hinged and may be selectively angled with respect to each other. Further, the spine portion is hinged or otherwise foldable to decrease the length thereof for easy storage and transportation of the same. The spine portion of the bracket may include painted, machined or laser cut designs to provide a unique impression.

It is another aspect of the present invention to provide a multipage bookmark that accommodates a plurality of page markers. The page markers may be made of any material, but preferably of a flexible material to facilitate placement between pages. In one embodiment of the present invention, the page markers are made of cloth and include a first end that is associated with a crimped metallic material that also includes an eyelet for receipt of a pin, which will be described in further detail below. The page markers may be of any color. For example, it is contemplated that the page markers be fabricated in school colors or be color coded to coincide certain sections of a book. Furthermore, the page markers may include other visual indicators, such as text to indicate passages of a book, such as in the Bible, i.e., to separate New Testament from Old Testament, for example. The page markers may be perforated, i.e., removable by tearing or cutting.

It is another aspect of the present invention to provide a mechanism for selectively receiving a plurality of page markers. In one embodiment of the present invention a pin connector is integrated onto the head portion and/or the upper portion of the bracket. Such pin clasps are commonly found on brooches and include a pin that is rotatably interconnected to a clevis. The other end of the pin is selectively engaged and secured onto a locking mechanism and opened and closed by a selectively rotatable member. Other similar mechanisms may be employed wherein the pin is fixedly interconnected to the head and/or bracket and is deflected and wherein the second end thereof is held in place by a hook or a claw. Devices employing pin clasps are described in U.S. Pat. Nos. 1,624,458 to Zook, 5,245,844 to Panzer and 7,013,540 to Wang et al., which are incorporated by reference herein. One embodiment of the present invention employs posts that emanate from the head that selectively receives a rod. The rod may be threaded on one end and screwed into one of the posts provided.

Any device employed to selectively receive and secure at least one of the page markers is contemplated. More specifically, the pin is adapted to be put through the eyelet of the page marker or markers and then refastened to another part of the pin assembly to secure the page markers in place. This type of system has the advantage of quickly allowing an individual to alter the number of page markers that they wish to employ. The drawback of many other bookmarks of the prior art is that the page markers are a fixed number wherein the remaining page markers are combined with the needed page markers, thus rendering the page marking less effective and making the book more difficult to close.

It is another aspect of the present invention to provide a bookmark having aesthetically pleasing items. For example, at least one charm may be associated with the head portion and/or bracket. The charms may include religious symbols, names, identifying indicia, school symbols, etc. The charms of some embodiments of the present invention are shaped as a cross, a chest, a locket, a dog tag, etc. One skilled in the art will appreciate that charms of various shapes may be employed without departing from the scope of the present invention. The charms are interconnected to the head by a band that may receive a plurality of beads or charms as well. Furthermore, an alternate embodiment of the present invention, perhaps in conjunction with a charm, employ a pouch associated with the head portion and/or bracket to receive glasses, a writing instrument, a magnifying glass, a flashlight, etc.

Another embodiment of the present invention employs a resilient band instead of the bracket described above. More specifically, one embodiment of the present invention employs a selectively resilient band that is positioned about the cover of the book similar to that disclosed in U.S. Patent Application Publication No. 2010/0058975. The resilient band also receives a head portion that secures the plurality of page markers described above. In another embodiment, a rod or other member is provided that is associated within the rings of a spiral notebook or binder. Furthermore, the bracket may be shortened in length to interconnect directly with the individual spiral or spirals or binder of a spiral notebook. It is envisioned that the head portion also be used with this embodiment of the present invention. As one of skill in the art will appreciate, the head portion may be used interchangeably with the bracket and/or band.

One embodiment of the present invention is constructed as follows. The head portion is attached to the upper portion of an L-shaped bracket wherein the head portion that is configured to function as a picture frame. Pop rivets may be used to attach the head portion to the upper portion of the L-bracket that are cut to remove excess length thereof. A photograph is then inserted into a frame integrated into the head portion. The page markers receive metallic ends that are crimped onto one end of the page marker. The pin is opened to allow the second end of the pin to be inserted through the eyelets of the crimped ends.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
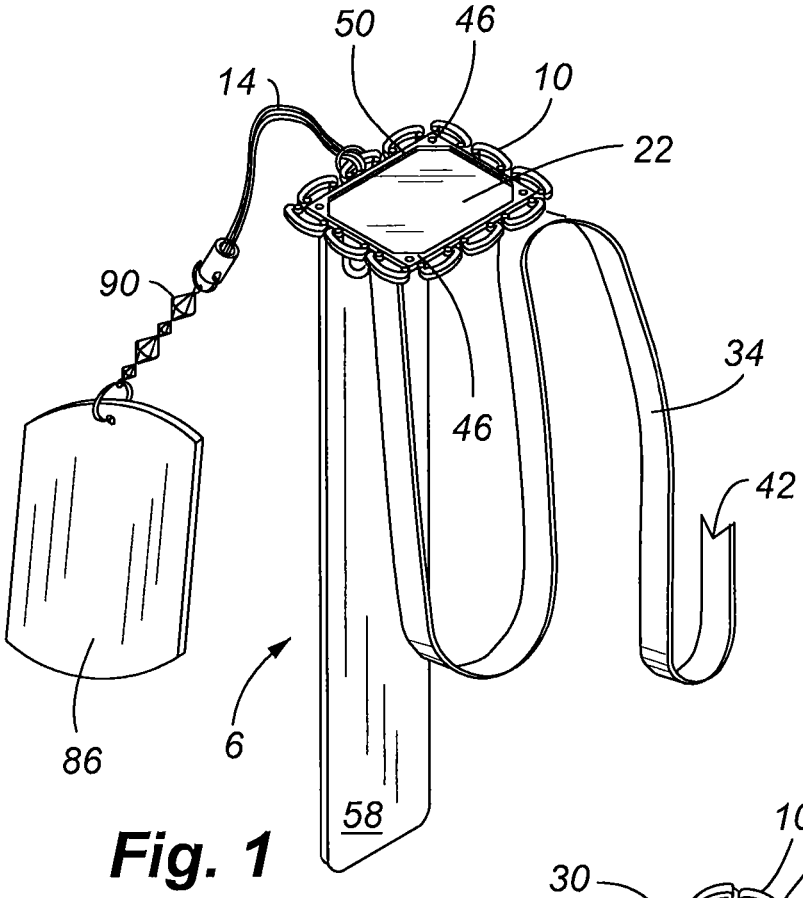
FIG. 1 is a perspective view of a bookmark of one embodiment of the present invention.

To assist in the understanding of one embodiment of the present invention the following list of components and associated numbering found in the drawings is provided herein:

| # | Components |
|---|---|
| 2 | Bookmark |
| 6 | Bracket |
| 10 | Head portion |
| 14 | Strap |
| 18 | Charm |
| 22 | Recess |
| 26 | Underside |
| 30 | Clasp assembly |
| 34 | Page marker |
| 38 | First end |
| 42 | Second end |
| 46 | Corner member |
| 50 | Outer edge |

-continued

| # | Components |
|---|---|
| 54 | Upper portion |
| 58 | Spine portion |
| 62 | Hook |
| 66 | Pin |
| 70 | Mount |
| 74 | Crimped metallic member |
| 78 | Hole |
| 86 | Charm |
| 90 | Bead |
| 94 | Book |
| 98 | Cover |
| 102 | Page |
| 106 | Liner |
| 110 | Space |
| 114 | Inner surface |
| 118 | Spine |
| 122 | Sleeve |
| 126 | Connecting member |
| 128 | Strap |
| 130 | Spine portion |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1, 2, 4 and 5, one embodiment of the present invention is shown. More specifically, the bookmark 2 of this embodiment of the present invention is generally comprised of a bracket 6 with an interconnected head portion 10. The head portion 10 is shown accommodating a strap 14 for holding a charm 18. The head portion 10 may also include a recess 22 for the receipt of a picture, for example. The underside 26 of the head portion 10 includes a clasp assembly 30 that accommodates a plurality of page markers 34 having a first end 38 and a second end 42.

Figure 2:
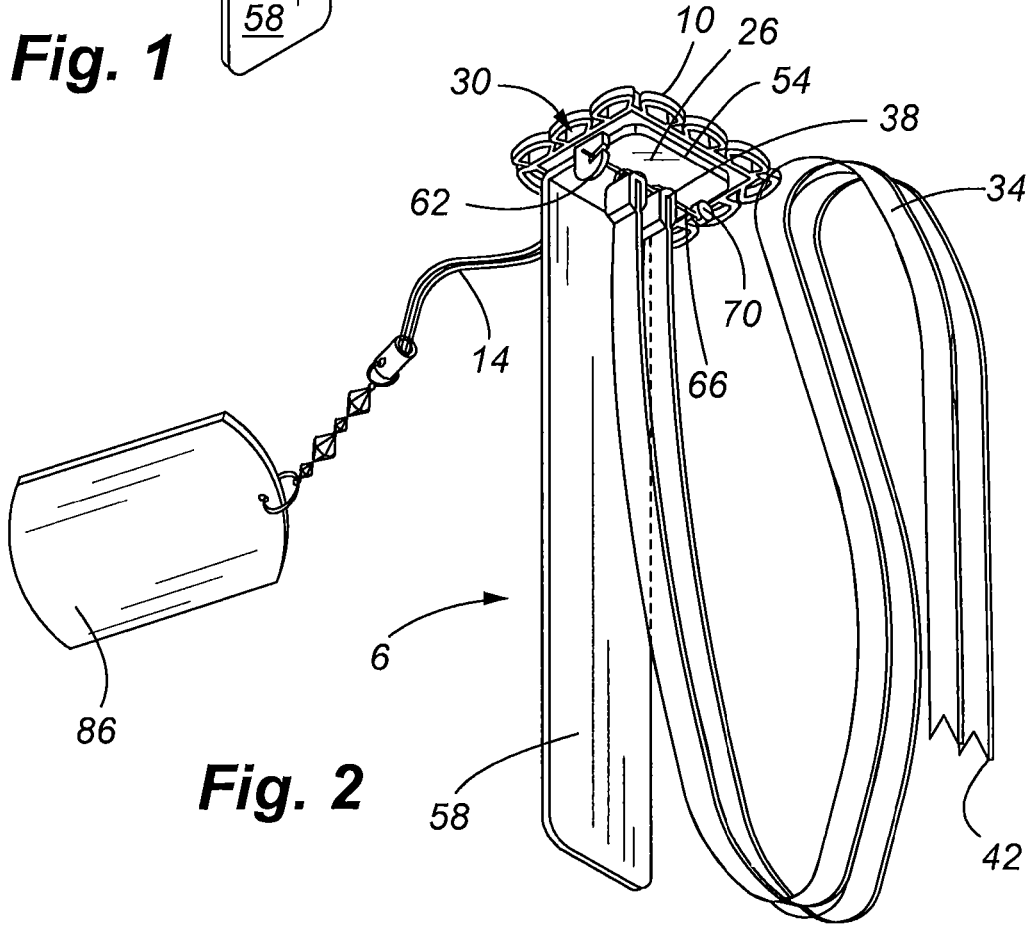
FIG. 2 is a bottom perspective view of FIG. 1.

Referring now specifically to FIGS. 1 and 2, the head portion 10 of one embodiment is made of die cast material, for example steel or aluminum. One of skill in the art will appreciate that the head portion 10 may also be made of plastic or other rigid material without departing from the scope of the invention. The head portion 10 includes a recess 22 having a plurality of corner members 46 or other members associated with the outer edge 50 thereof that are designed to secure a photo or other item within the head portion 10. Thus, the head portion 10 of the embodiment of the present invention shown is designed to be used similar to a picture frame. The corner members 46 may be omitted wherein an adhesive is used to secure the photo or other embellishment to the head portion 10.

The bracket 6 provided possesses an upper portion 54 for engagement to the head portion 10 and an elongated spine portion 58 for engagement to a book, which will be described in further detail below. The upper portion 54 of the bracket 6 of one embodiment of the present invention is about 0.750 inches long, the spine portion 58 is about 3.4 inches long and the thickness is about 0.32 inches. The bracket 6 may be made out of any rigid plastic or material. One embodiment of the present invention is made of aluminum 5052.

The clasp assembly 30 is comprised of a hook 62 that selectively receives a pin 66 that is hingedly interconnected to a mount 70 that is associated with the head portion 10. In operation, the pin 66 would be selectively removed from the hook 62, thereby allowing the plurality of page markers 34 to be associated therewith. After the page markers 34 were associated with the pin 66, the free end would again be interconnected to the hook 62 to secure the page markers 34 to the head portion 10. The head portion 10 may be interconnected to the bracket 6 by way of soldering, welding or by rivets. One embodiment of the present invention contemplates welding or soldering the clasp assembly 30 to either the head portion 10 or the upper portion 54 of the bracket 6.

FIG. 2 shows the plurality of page markers 34 integrated to the clasp assembly 30. Each page marker 34 comprises the first end 38 and the second end 42 wherein the first end includes a device for associating the page marker 34 to the pin 66 of the clasp assembly 30. The first end includes a crimped metallic member 74 having a hole 78 therethrough for receipt of the pin 66. Second end 42 of the page marker 34 is generally free and adapted to fit between pages of a periodical or book. The page marker 34 may be of any material but is preferably quite flexible to allow it to be easily inserted between pages.

Embodiments of the present invention are adapted to include additional features to enhance the appearance thereof. More specifically, the strap 14 may be provided that is associated with the head portion 10 on one end and associated with a charm 86 on the other end. Shown in the figures, a dog tag shaped charm 86 is employed. The charm 86 may include a picture or symbol as described above. One of skill in the art will appreciate that the charm 86 may comprise a cross, crucifix, Star of David, etc. without departing from the scope of the invention. Furthermore, a plurality of beads 90 may be associated with the charm 86 or the strap 14. That is, one skilled in the art will appreciate that additional charms 86, often associated with charm bracelets may be used to enhance the appearance of the book mark 2 or personalize the same.

Figure 3:
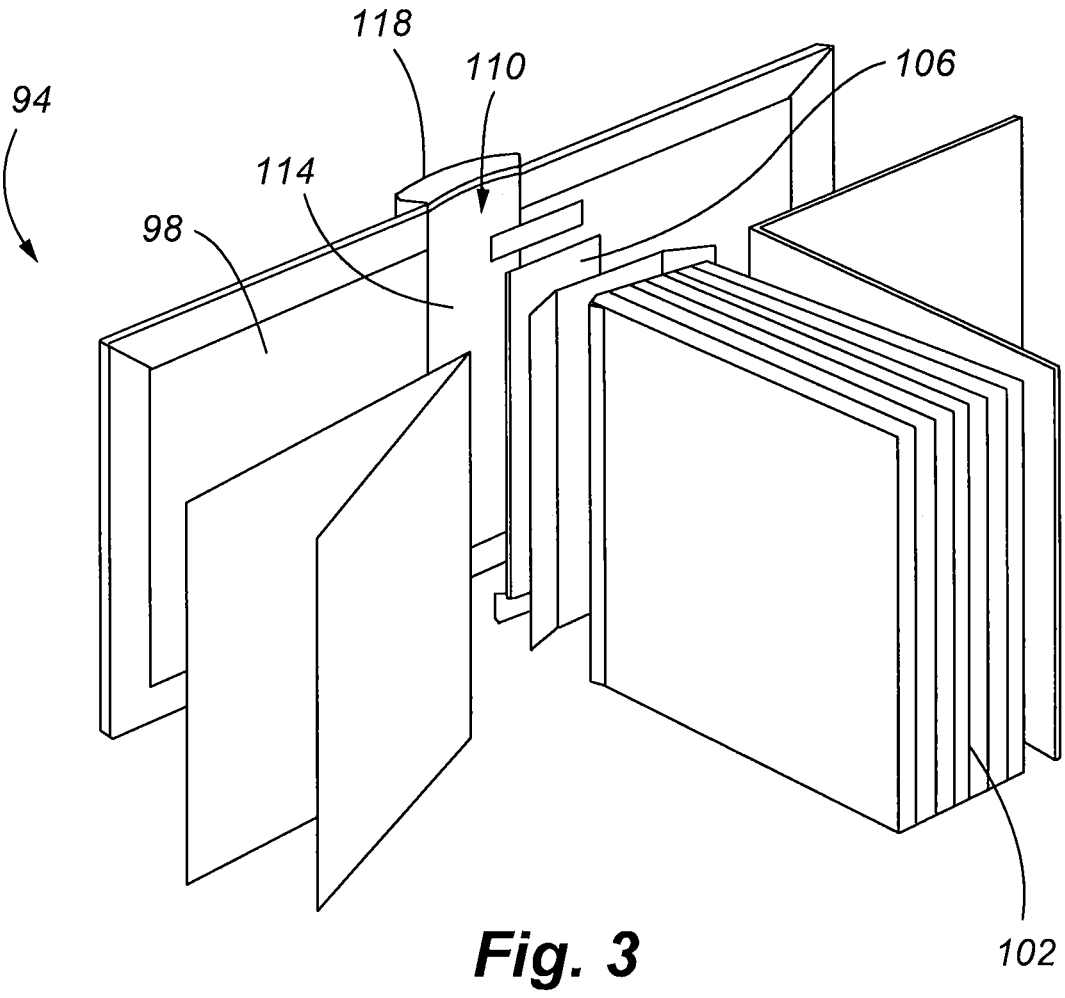
FIG. 3 is an exploded perspective view of a typical bound book.
Figure 4:
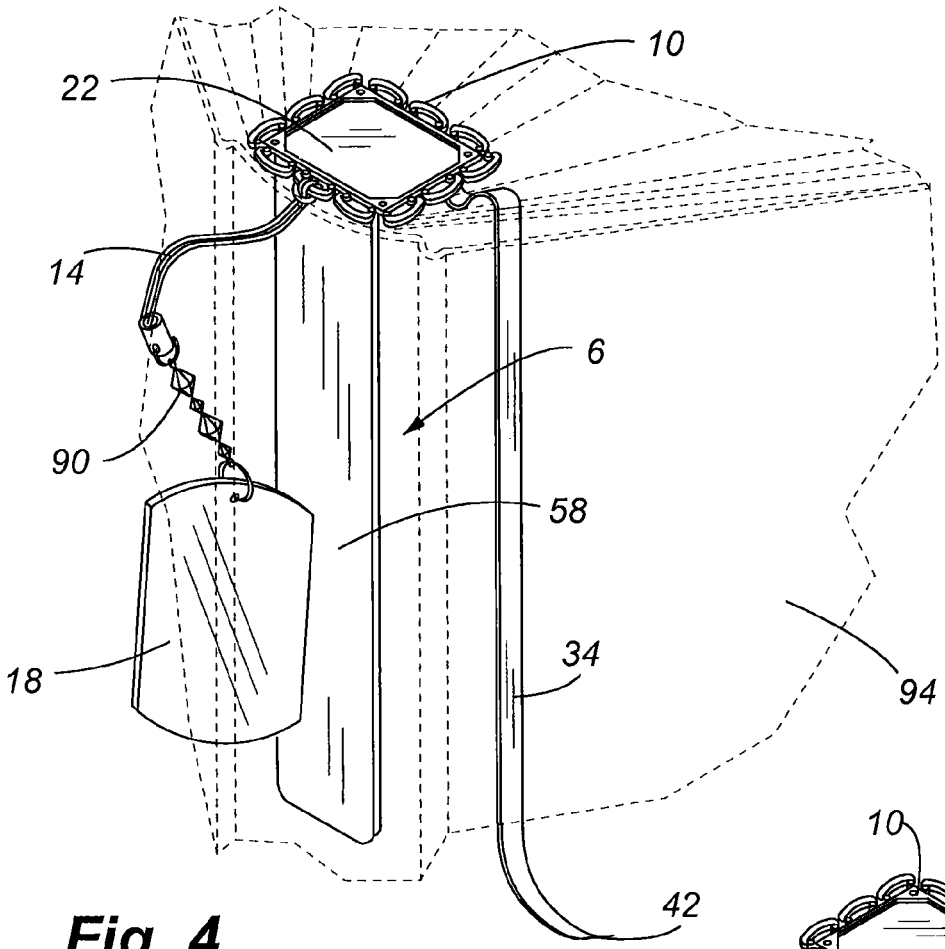
FIG. 4 is a perspective view showing one embodiment of the present invention associated with a book.

Referring now specifically to FIGS. 3 and 4, the bookmark 2 of one embodiment is shown integrated into a book 94. Typical bound books 94 are comprised of a rigid outer cover 98 that is interconnected to a plurality of pages 102 via a liner 106. A space 110 exists between the liner 106 and an inner surface 114 of the book spine 118 that receives the spine portion 58 of the bracket 6 as shown in FIG. 4. One of skill in the art will appreciate that the head portion 10 may also include elastic bands associated therewith that integrate directly with the covers 98 of the book 94 to secure the head portion 10 and associated page markers 34 to the book 94. In such instances, the bracket may be omitted or simply placed on the outside of the spine 118. Placement of the spine portion 58 within the space 110 associates the head portion 10 with the book 94, thereby allowing individuals to place individual page markers 34 between the pages of the book. Additional page markers 34 may be added or removed at will. One of skill in the art will appreciate that excess page markers 34 may be placed outside of the cover 98 if not in use.

Figure 5:
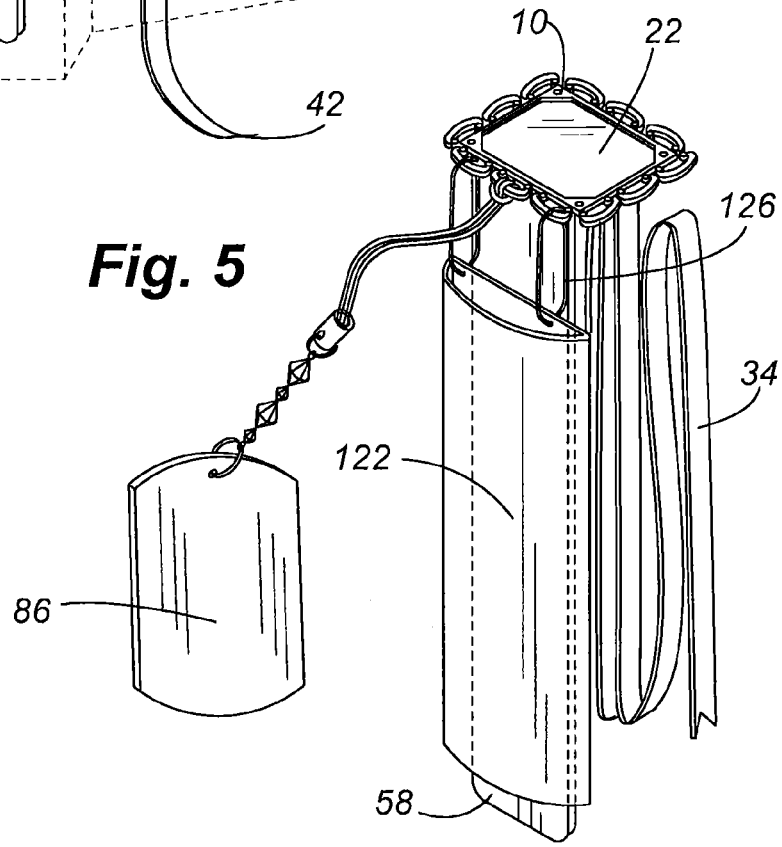
FIG. 5 is a perspective view of another embodiment of the present invention and is used in conjunction with a sleeve for holding a pen, for example.

FIG. 5 shows another embodiment of the present invention that includes a sleeve 122 for receiving a pen, magnifying glass, light, eyeglasses, etc. The sleeve 122 is associated with the head portion 10 by way of at least one connecting member 126, i.e. a strap. In operation, the spine portion 58 of the bracket 6 would be placed between the spine and the book liner as described above wherein the sleeve 122 is positioned outside of the spine and enabled to receive at least one pen, for example.

Figure 6:
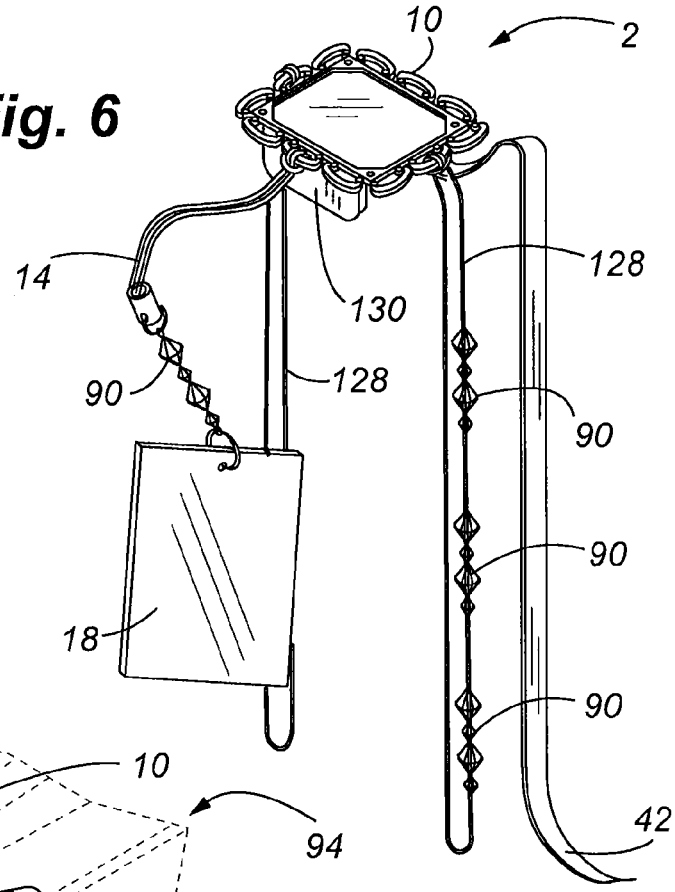
FIG. 6 is a perspective view of a book mark of another embodiment of the present invention.
Figure 7:
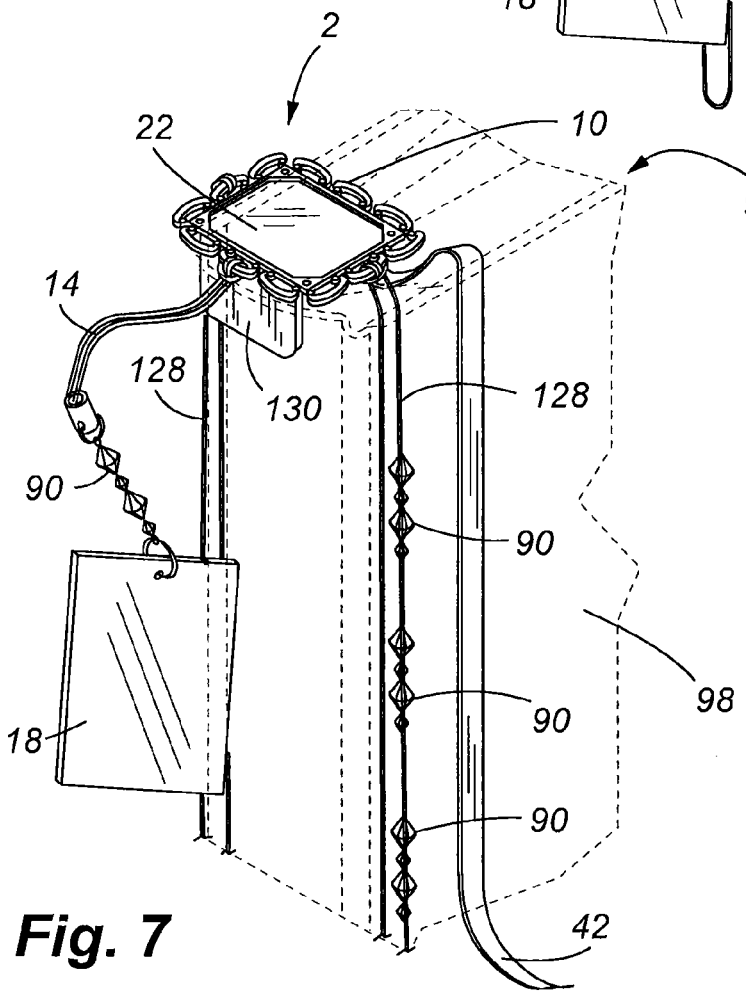
FIG. 7 is a perspective view showing the embodiment of FIG. 6 associated with a book.

FIGS. 6 and 7 show another embodiment of the present invention that employs an elastomeric strap 128 to affix the bookmark 2 to the book 94. More specifically, elastomeric straps 128 are associated with the head portion 10 of the bookmark 2 that are placed around the front and rear covers 98 of the book 94 to hold the head portion 10 adjacent to the top of the book 94. The head portion 10 may also employ a shortened spine portion 130 that helps maintain the head portion 10 in a proper orientation. The spine portion 130 may be placed within the spine as described above or located outside of the spine. This embodiment of the present invention is ideal for use with soft-covered books that may not be adapted to accommodate an elongated spine portion as described above. This embodiment of the present invention also includes a strap 14 with associated charm 18 and beads 90. Furthermore, some embodiments of the present invention employ beads 90 on a portion of the strap 128.

In one embodiment of the present invention, the bracket 6 is made of aluminum and is bent or cast into the shape shown. The head portion is die cast and soldered or otherwise interconnected to the upper portion 54 of the bracket 6. The recess 22 of the head portion 10 receives a picture or other item described above. One of skill in the art will appreciate that the recess is not required.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A system for selectively marking a plurality of pages of a book, comprising:

a bracket having a first portion and a second portion that is adapted to be associated with the book;

a head portion interconnected to said first portion of said bracket, said head portion having a recess adapted to receive a photograph;

a clasp interconnected to said head, said clasp comprising a pin with a first end hingedly interconnected to a mount and a second end selectively interconnected to a hook, said mount and said hook being interconnected to said head;

at least one page marker selectively interconnected to said pin; and wherein when said second end of the bracket is positioned between a spine and pages of the book, said at least one page marker is adapted to be positioned between the pages of the book.

2. The system of claim 1, wherein said at least one bookmark has a first end that is comprised of crimped metal with an aperture that receives said pin.

3. The system of claim 1, further comprising a sleeve associated with said head portion that is adapted to receive at least one of a writing instrument, a pair of eye glasses and a magnifying glass.

4. The system of claim 1, wherein said first portion and said second portion of said bracket are operably interconnected.

5. The system of claim 1, wherein said second portion is foldable.

6. The system of claim 1, wherein said head portion is selectively interconnected to said first portion.

7. The system of claim 1, wherein at least one of said bracket and said head portion is adapted to receive information.

8. The system of claim 1, wherein said head portion includes a digital picture frame.

9. The system of claim 1, further comprising a charm interconnected to said head portion.

10. The system of claim 9, wherein said charm is interconnected to said head portion by way of a strap that has at least one bead associated therewith.

11. A bookmark for identifying a plurality of pages of a book, comprising:

a bracket for interconnecting to a book, said bracket having a first portion and a second portion;

a head portion interconnected to said first portion of said bracket;

a clasp interconnected to said head portion, said head comprising a mount and a hook that are interconnected to said head portion, said clasp also comprising a pin with a first end hingedly interconnected to said mount and a second end selectively interconnected to said hook; and at least one page marker selectively interconnected to said pin.

12. The bookmarker of claim 11, wherein said means for interconnecting is a band adapted for interconnection to the cover of the book or a bracket having a first portion and a second portion that is adapted to be associated with the book, wherein when said second end of the bracket is positioned between a spine and pages of the book, said at least one page marker is adapted to be positioned between the pages of the book.

13. The bookmark of claim 11, wherein said head portion possesses a recess adapted to receive a photograph.

14. The system of claim 11, further comprising a decorative item interconnected to said head portion.

15. A multi-page bookmark for selective attachment positioning or interconnecting to a book having a front cover and a rear cover connected by a spine, said bookmark having a bracket with a second portion for insertion adjacent to an inner surface of a spine and a first portion interconnected to a head portion, said head portion receiving at least one elongate page marking ribbon, the improvement comprising:

a clasp for securing said at least one elongate page marking ribbon interconnected to said head, said clasp comprising a mount and a hook that are interconnected to said head portion, said clasp also comprising a pin with a first end hingedly interconnected to said mount and a second end selectively interconnected to said hook.

16. The bookmark of claim 15, wherein said at least one page marking ribbon has a first end that is comprised of crimped metal with an aperture that receives said pin.

17. The bookmark of claim 15, further comprising a sleeve associated with said head portion that is adapted to receive at least one of a writing instrument, a pair of eye glasses and a magnifying glass.

18. The bookmark of claim 15, wherein said head portion is selectively interconnected to said first portion.

19. The bookmark of claim 15, wherein said head portion includes a digital picture frame.

20. The bookmark of claim 15, further comprising a charm interconnected to said head portion.

21. The bookmark of claim 20, wherein said charm is interconnected to said head portion by way of a strap that has at least one bead associated therewith.

* * * * *